US006482783B1

(12) United States Patent
Lewis et al.

(10) Patent No.: US 6,482,783 B1
(45) Date of Patent: Nov. 19, 2002

(54) FOAM FABRIC FRESHENER COMPOSITION AND METHOD

(75) Inventors: James A. Lewis, Westfield; Robert J. Hecking, Rutherford, both of NJ (US)

(73) Assignee: Mane, U.S.A., Wayne, NJ (US)

( * ) Notice: Subject to any disclaimer, the term of this patent is extended or adjusted under 35 U.S.C. 154(b) by 67 days.

(21) Appl. No.: 09/678,670

(22) Filed: Oct. 4, 2000

Related U.S. Application Data

(60) Provisional application No. 60/157,613, filed on Oct. 4, 1999.

(51) Int. Cl.[7] ..... C11D 17/04; D06L 17/04
(52) U.S. Cl. ..... 510/279
(58) Field of Search ..... 510/279

(56) References Cited

U.S. PATENT DOCUMENTS 4,035,148 A 7/1977 Metzger et al.
4,242,377 A 12/1980 Roberts et al.
4,915,934 A 4/1990 Tomlinson
5,679,324 A 10/1997 Lisboa et al.

FOREIGN PATENT DOCUMENTS

CA 2260921 2/1998

*Primary Examiner*—Yogendra N. Gupta
*Assistant Examiner*—John M. Petruncio
(74) *Attorney, Agent, or Firm*—Pillsbury Winthrop LLP

(57) ABSTRACT

A foam forming composition contains a freshening agent and a foam-forming anionic surfactant in amount sufficient to form a foam when dispensed from a pressurized vessel, but in an amount insufficient to effect fabric cleaning. The foam provides a visible means for the user to observe the area of application and thus avoids the likelihood of over- or under-spraying. An anti-foaming agent is included in the foam forming composition to provide for a quick breaking and fast drying foam. The freshener agent is applied as a visible foam to carpets or other fabrics and the foam quickly disappears and dries and requires no vacuuming, abrasion or scrubbing.

6 Claims, No Drawings

FOAM FABRIC FRESHENER COMPOSITION AND METHOD

CROSS-REFERENCE TO RELATED APPLICATIONS

This application is the non-provisional application of provisional application 60/157,613, filed Oct. 4, 1999.

BACKGROUND OF THE INVENTION

1. Field of the Invention

This invention relates to compositions for freshening or deodorizing carpets, upholstery, drapes, and other fabric or similar surfaces and to a method utilizing such compositions. More particularly, this invention relates to compositions which are adapted for dispensing from valved dispensers, in the form of foam, for easily and visibly applying to fabrics, including carpeting, drapes and upholstery, a freshening or deodorizing active ingredient, and which after application, is quick drying to the touch.

2. Discussion of the Prior Art and Problems to be Solved

Many fabrics installed in the home or office, such as wall to wall carpeting, stretched fabric on ceiling or walls, upholstery, drapes, and the like, absorb cooking odors, pet odors, smoke odors, and other often obnoxious or otherwise unpleasant odors. Although these fabrics may be clean from the perspective of being free of color changing dirt, the odors they absorb render them not fresh. Since they can not be easily removed for cleaning or freshening they present a challenge for most homeowners and for many office workers.

Currently, fabric freshening products are commercially available as either powder, water based pumps or aerosol products. Powder products, while having the advantage of being relatively easy to visualize the areas of application, have the drawbacks that they tend to leave a residue powder which can work its way through the carpet, and are generally not used on upholstered furniture. Moreover, the powder freshener products, which typically include fragrance added to sodium sulfate, are applied to the carpet with a salt shaker type canister. The powder does not thoroughly cover the rug, so fragrance transfer to carpet, if any, is spotty. In fact, the major freshening from powdered carpet fresheners is actually from the vacuum cleaner; as the powder is removed from the carpet into the vacuum, large volumes of air passing through the vacuum distribute the fragrance into the air. As a result of the tendency to be picked up and redistributed by the vacuuming process the carpet is left with only minor fragrance residual.

Aerosol or pump spray products (typically spraying liquid fresheners with cyclodextrins), while often more effective than powder products, are difficult to visualize on the areas to which the product has been applied. Therefore, the users tend to inadvertently spray the same area twice or miss large areas, because the area of application cannot easily be seen. Because the ultimate action is to absorb malodors, a not insignificant amount of time is required to absorb the odor and for the fabric to dry from the water base of these products. Consumers tend to overspray an area to affect the malodor absorption but because of the time for absorption, they leave the carpet or other fabric wet to the touch for long periods.

It is known to provide carpet cleaning products in the form of a sprayable foam composition and, such cleaning products may often include a perfume or other odorant product in minor amounts. However, such foam carpet/fabric cleaning products also tend to leave the carpet/fabric wet to the touch for extended periods, requiring scrubbing and/or vacuuming to remove residues, and do not provide and are not intended to affect long term freshening or deodorizing effects.

U.S. Pat. No. 4,035,148 discloses a carpet cleaning and soil repellant composition which is substantially surfactant free and consists essentially of a water-soluble phosphate and a water-insoluble alumina having a particle size less than 3 microns in a ratio of from 1:1 to 1:35. The compositions may be applied from an aqueous medium and may be provided in the form of an aerosol.

WO 9804666 discloses a foam forming aerosol cleaning composition for rugs, carpets, and the like, including about 0.1 to 6% of foam forming surfactant, about 0.5 to 5% of non-volatile, hydrophobic organic solvent having a water solubility of less than about 18% at 25° C., an effective amount of an emulsifier, an effective amount of propellant, and balance water.

U.S. Pat. No. 4,915,934 discloses a biocidal composition for hand and skin disinfection. The composition contains an aqueous alcoholic chlorhexidine solution in an aerosol form, the major component (i.e., 70 to 96.9%) being a quick breaking alcoholic agent which comprises an aliphatic alcohol and a fatty alcohol. Other ingredients of the composition include water, surface active agent and aerosol propellant (3 to 20%) and chlorhexidine (0.1 to 10%). The formulations are stored in corrodible metal containers so further include a corrosion inhibiter.

Accordingly, it would be advantageous to provide a composition for freshening or deodorizing fabrics, including carpeting, upholstery and the like, which do not have the above noted drawbacks of powder, pump or non-foam aerosol freshener products or foam cleaning products.

SUMMARY OF THE INVENTION

It has now been discovered that fabric freshening agent, such as, fragrance, may be evenly and uniformly distributed in the form of an aerosol foam from an aerosol dispenser, thereby allowing the consumer to see exactly where the product has landed and therefore, cover the entire fabric surface with little or no overlap. Accordingly, the fragrance delivery to the fabric is not spotty or incomplete, and wetness is minimized.

As a foam is a gas entrapped in liquid, less liquid is delivered to treatment areas and drying is much quicker. Therefore, using the compositions of this invention offers the advantages of faster drying, more uniform and thorough application, less product waste, and, of very great significance to the consumer, eliminating the need to vacuum without leaving behind messy salts and powders not removed by vacuuming.

Basically, the present invention provides a non-cleaning foam forming composition for dispensing freshening agent comprising, in its preferred embodiment, solvent, propellant, freshening agent, foaming surfactant, anti-foaming agent, and water, and optionally, but preferably, anti-soilant.

In another aspect, the present invention provides a pressured non-cleaning foam forming composition for dispensing freshener onto a surface requiring deodorizing, comprising a valved vessel containing therein a foamable pressurized composition comprising solvent, freshening agent, foaming surfactant, anti-foaming agent, anti-resoiling agent, water, and propellant, whereby, when dispensed from said valved dispenser onto a surface, the composition forms a visible foam effective to freshen said surface.

Preferably, the foam forming composition will include a small amount (less than the amount required for cleaning) of surface active agent to assist in the foaming process after the composition is dispensed. The composition may also preferably include a small amount of antifoaming agent to assist in the quick breakup or dissipation of foam shortly after the foam has formed on the fabric. An anti-resoiling additive is especially preferred for products intended for use in freshening carpets, but may also be included in products intended for freshening other fabric materials and fabric types.

According to still another aspect of the invention there is provided a method for freshening or deodorizing a fabric such as carpet, upholstery, drapes and the like, which includes the steps of dispensing from an aerosol container a foam containing freshening agent onto a first portion of fabric. The foam preferably contains an effective amount of surface active agent to cause foaming, but an amount ineffective to clean the fabric. The foam contains from about 40 to no more than about 80 percent by weight water or an aqueous organic solvent mixture containing no more than about 5% by weight of the mixture of organic solvent.

According to this invention, the foam remains visible for a time sufficient to allow the user to ascertain the area of coverage and determine whether additional product needs to be applied to the same general area or adjacent area of the carpet, rug or other fabric being treated. Usually, it is sufficient if the foam remains visible for about 30 seconds, although times ranging from about 10 seconds to about 1 minute should be satisfactory for most users to clearly observe the areas where the foam has landed. Thereafter, the foam is allowed to dissipate and air dry. Air drying will be substantially or totally complete in no more than about 5 minutes, and preferably in no more than about 3 minutes. In addition, this method leaves no residual powder or other solids requiring removal by vacuuming or sweeping or other means. The process may be repeated on adjacent or other portions of the fabric until the entire fabric, or part thereof requiring deodorizing or freshening, has been deodorized or freshened.

DETAILED DESCRIPTION AND PREFERRED EMBODIMENTS

The present invention provides a foamable composition for dispensing a freshening agent (e.g.,fragrance, perfume, deodorant, odorant, absorbent, adsorbent, etc.) in the form of a foam, from a valved aerosol type dispensing vessel. Because it is dispensed as a foam, the consumer may readily see exactly where the product has landed. Thus, the tendency to overspray or underspray areas is avoided or minimized.

The foam is also designed to remain visible for only a relatively short period of time, usually from about 10 seconds to about one minute, preferably about 30 seconds, after which time the foam will spontaneously break up and dissipate and the freshening agent will be distributed on and throughout the fibers of the fabric material. After foam break-up the water and other volatile components will rapidly volatilize so that the treated fabric appears dry to the touch in less than about 5 minutes. The evaporation rate and actual drying time may differ depending on the relative humidity in the area of application but will generally be independent of the type of fabric on which the foam is applied. However, since the foam helps to minimize the water or solvent load on the fabric, the extent of foaming and the water/solvent content will effect the evaporation and drying time.

Therefore, by operating within the preferred conditions described herein, the fabric dries faster, the freshener agent is applied more evenly and more thoroughly (even though smaller overall quantities may be dispensed). Because the drying occurs rapidly, and because substantially no unwanted solids or messy salts remain behind, no further action by the consumer, including vacuuming or scrubbing, is required. Thus, this product provides substantial convenience to the consumer not available with existing fabric freshening products.

In the present application a foam is meant to include any dispersion of a gas in a liquid. Preferably, the liquid will be water, although small amounts of other volatile co-solvents may be incorporated to assist in solubilizing fragrance.

Surface active agents (surfactants) are used in the foamable compositions of this invention in minor amount, effective to promote foaming but ineffective to serve a cleaning or detergent function. Similarly, other detergent or cleaning aide ingredients, such as detergent builders, e.g., water-soluble phosphates, such as the alkali metal and ammonium inorganic phosphates, are not added to the compositions of this invention.

Lengthy descriptions of suitable foaming surfactants may be found in the patent literature and texts, for example, Surface Active Agents and Detergents, Volumes I and II, by A. M. Schwartz, J. W. Perry and J. Berch, published in 1958 by Interscience Publishers, Inc., and McCutcheon's Emulsifiers and Detergents, 1998, North American Edition, MC Publishing Co., incorporated herein by reference, but nevertheless a listing of some such representative compounds will be given.

The anionic surface active agents include the sulfuric reaction products having a higher alkyl or acyl radical therein. Some of these are: the higher alkyl benzene sulfonates, preferably with the alkyls being linear; N-higher acyl sarcosides; alpha-olefin sulfonates; paraffin sulfonates; higher fatty acyl taurides and isethionates; higher fatty acid monoglyceride sulfates and sulfonates; and more specifically, tallow alcohol sulfate, coconut oil monoglyceride sulfate and n-dodecyl benzene sulfonate, as the sodium, potassium and triethanolamine salts. Normally the anionic surface active materials will have approximately balanced hydrophile-lipophile ratios and the higher alkyl or acyl will be of 10 to 20 carbon atoms, preferably 12 to 18 carbon atoms.

As specific examples of suitable foaming anionic surfactants mention may be made of, for example, sodium lauryl sulfate, sodium lauroyl sarcosinate, ammonium lauryl sulfate, disodium sulfosuccinate, alkyl ether sulfates, and the like.

The foam forming surfactant will be present in the compositions in amounts sufficient only to provide adequate foaming upon release from the pressurized vessel, usually in an amount of from about 0.05 wt % to about 1.5 wt %, preferably from about 0.1 wt % to about 0.75 wt %, based on the total foamable composition.

The water employed in the conditioning compositions is preferably deionized or of low hardness, under 50 parts per million of hardness, calculated as calcium carbonate. It will usually be undesirable for it to contain dissolved salts to an extent of more than 0.1%.

Small amounts of organic solvents, such as $C_{2-3}$ aliphatic alcohols, e.g., ethanol or isopropanol, may also be included to assist in solubilizing any water-insoluble or difficultly soluble ingredients, especially, oily perfume ingredients. When present, the amount of organic solvent in the aqueous phase will be sufficient to effect solubilization of any difficultly soluble ingredients but less than about 5%, preferably less than about 2.5%, by weight, based on the weight of water, and less than about 3%, preferably less than about 2% by weight, based on the total weight of the foamable composition.

The gas phase of the foam is typically comprised of propellant.

In this regard, the addition of propellant to the aqueous formulation substantially reduces the overall water (or aqueous solvent) content to facilitate the drying of the foam after deposition on fabric.

Examples of suitable propellants include any of those commonly used in aerosol dispensers, taking into account, such factors as, for example, any local government restrictions, the compatibility with other ingredients, the type of vessel and valve mechanism for storing and dispensing the foamable composition, cost, and the like. Satisfactory propellants include primarily the $C_{2-4}$ saturated aliphatic hydrocarbons, e.g. propane, butane, and isobutane. However, in jurisdictions where use of fluorocarbon propellants are not banned, $C_{1-2}$ halogenated hydrocarbons, e.g., trichloromonofluoromethane, dichlorodifluoromethane, trichlorotrifluoroethane and dichlorotetrafluoroethane, may also be used. The normally gaseous hydrocarbon propellants, especially, isobutane and propane and mixtures thereof, e.g., an 80/20 isobutane/propane mixture, commercially available under the designation A 46 propellant, or a 52/48 isobutane/propane mixture (A 70 propellant) are able to achieve the desired pressures, and are preferred because of environmental safety considerations, cost, and low corrosiveness. Other propellants, such as, for example, dimethyl ether, and difluoroethane, may also be used but currently are more expensive as well as giving different foam properties. Carbon dioxide and nitrogen oxides or other compressible gases are generally not effective or desirable.

The amount of the propellant agent(s) will be selected to provide the desired vessel pressure for satisfactorily dispensing substantially all of the composition from the vessel. Usually, the amount of propellant will fall within the range of from about 20 wt % to about 40 wt %, preferably, from about 24 wt % to about 27 wt %, based on the total foamable composition.

In addition, the inclusion in the composition of an anti-foaming agent effectively destabilizes the cell walls of the foam when exposed to air. Consequently, the foam breaks within about 30 seconds, substantially independently of the amount or thickness of the applied foam, to allow the liquid phase to quickly evaporate and speed the drying process.

Moreover, the presence of anti-foaming agent assures that the foam will break up quickly and that the freshening agent will be distributed on the fabric and the solvent/liquid components of the foam will evaporate and feel dry to the touch in a very short time so that the user may be able to regain full use (e.g., walking on carpet, sitting on upholstered furniture, etc.) of the fabric more quickly than with known freshening powders and liquids.

The selection of the anti-foaming agent is not particularly critical so long as it does not interfere with foam generation during application and does not break the foam too quickly, so as to avoid removing the applied freshening agent.

As non-limiting examples of anti-foaming agents, mention may be made, for example, of silicone antifoaming agents, such as for example, dimethicones (dimethyl siloxane polymers); and silicate antifoaming agents.

The amount of the anti-foaming agent is particularly critical and should be present within the range of from about 0.2% to about 0.5%, preferably from about 0.25% to about 0.40% by weight of the total foamable composition. When the amount is greater than about 0.5 wt %, it may be difficult for the foam to form. When the amount is less than about 0.2 wt %, the effectiveness of its foam breaking action is impaired.

The selection of suitable freshening, e.g., odorizing/deodorizing, agents is also not critical and may be freely chosen from various volatile odorous agents, including essential oils, aromatic chemicals and the like. A great variety of these materials are known to those skilled in the perfuming arts and these materials may comprise, for example, one or more natural or synthetic aromatic agents or mixtures thereof.

Preferably, the freshening agent is fragrance or perfume to impart a desired aroma, or to mask odors that may be associated with the fabric to be treated.

Any fragrance suitable for application to fabric can be used herein including a wide variety of fragrances and perfumes that are known to those skilled in the art. The particular perfume used is largely a matter of choice, however, the fragrance should be used at a level effective for providing a noticeable aroma or for masking undesired aroma.

Fragrances are made by those skilled in the art in a wide variety of fragrances and strengths. Typical fragrances are described, for example, in Arctander, Perfume and Flavour Chemicals (Aroma Chemicals), Vol. I and II (1969); and Arctander, Perfume and Flavour Materials of Natural Origin (1960).

Examples of such components useful in fragrances herein include decyl aldehyde, undecyl aldehyde, undecylenic aldehyde, lauric aldehyde, amyl cinnamic aldehyde, ethyl methyl phenyl glycidate, methyl nonyl acetaldehyde, myristic aldehyde, nonalactone, nonyl aldehyde, octyl aldehyde, undecalactone, hexyl cinnamic aldehyde, benzaldehyde, vanillin, heliotropin, camphor para-hydroxy phenolbutanone, 6-acetyl 1,1,3,4,4,6 hexamethyl tetrahydronaphthalene, alpha-methyl ionone, gamma-methyl ionone, and amyl-cyclohexanone and mixtures of these components. Fragrance used in the present invention may also contain solubilizers, diluents, or solvents which are well known in the art. Such materials are described in Arctander, Perfume and Flavour Chemicals (Aroma Chemicals), Vol. I and II (1969). These materials typically include dipropylene glycol, diethylene glycol, $C_1$–$C_6$ alcohols, preferably $C_{2-3}$ alcohols, and benzyl alcohol. Thus, the present invention contemplates various fragrances or perfumes, such as essential oils having a floral bouquet, or a fruity, citrus, herbal or spice fragrance, etc, and substantive fragrance materials, as well known to those skilled in the art.

The amount of the freshening agent(s) in the composition may be freely chosen depending on the strength of the agent and the intended fabric to be treated and the desired results. Suitable amounts may be easily determined by the skilled practitioner. Generally, however, the amount of freshening agent will be chosen within the range of from about 0.5 wt % to about 2.0 wt %, preferably from about 0.6 wt % to about 1.5 wt %, based on the total foamable composition.

In addition to the water, anti-foaming agent, freshening agent and propellant, the compositions of this invention may also include various adjuvants to provide additional aesthetic or functional attributes to the freshening foam product.

One particularly preferred additive ingredient is an anti-soiling or soil anti-redeposition agent or oil adsorbent. Since the freshener agent, such as fragrance component, is typically comprised of an oily substance, build-up on carpets or other fabrics, may be eliminated by incorporating an oil adsorbent or soil anti-redeposition agent. Suitable materials are commercially available. Mention may be made, for example, of inorganic substances, such as hydrous sodium lithium magnesium silicates (e.g., Laponite), or organic substances, such as carboxylated polymer salts, such as Zelan 338, a trademarked product of E.I. duPont Nemours & Co., and modified non-ionic polymers, such as Sokalan HP 22G.

In addition to their antisoiling effect, these agents also may function as antistatic agents or additional antistatic agents, as well known in the art, and in amounts which do not interfere with the foaming properties, may be included in the compositions.

When present in the composition, the amount of the antisoiling agents may suitably fall within the range of from about 0.05 wt % to about 2 wt %, preferably, from about 0.2 wt % to about 1.2 wt %, based on the total weight of the foamable composition.

Other optional additives, in amounts which may be readily determined by those skilled in the art, and which will not interfere with foam formation or foam dissipation or other objects of the invention, include, for example, preservatives and antimicrobials, coloring agents, optical brightening agents, fluorescent agents to mask staining on carpets, anti-corrosion agents, ultra-violet absorbers and the like, as well known to those skilled in the art.

In one aspect of the present invention, the foam is dispensed from a package which comprises a sealed container, such as an essentially cylindrical bottle, having a dispensing means such as a valve or valve/nozzle assembly. The container contains the composition including propellant gas. Suitable containers may be made from any material, especially aluminum, tin-plate, glass, plastics including PET, OPP, PE or polyamide and including mixtures, laminates or other combinations of these. Foam is dispensed when the dispensing means is activated and the foamable composition is released together with the propellant gas. The propellant gas expands to form many "bubbles" within the composition thereby creating the foam.

Thus, the quick breaking foams of this invention are formed upon discharging the pressurized foam forming composition to the atmosphere through an ordinary dispensing valve and actuator. Selection of an appropriate dispensing valve and actuator is critical, depending on, primarily, the desired characteristics of the foam product and spray pattern, and may be readily chosen. Dispensing aerosol type valves are commercially available from several sources in a variety of dimensions.

Discharge may be very quick, usually occurring in less than ten seconds, and the foam produced, which is of essentially the same composition as the pressurized product before dispensing, with the propellant expanding to produce the foam, will remain visible for usually about 30 seconds or somewhat longer or shorter. This time will be sufficient for the user to observe the area of the fabric on which the foam, and hence, freshener agent, has been applied.

Thereafter, due to the surface tension reducing effect of the anti-foaming agent, the walls of the foam will break and the propellant substantially immediately completely volatilizes. The solvent component and other volatile components, if any, will also rapidly evaporate such that the fabric will feel dry to the touch within only a few to several minutes, generally being completely or substantially completely dry within about 5 minutes or less, while the freshening agent is uniformly distributed in and on the fabric being treated.

As shown in the following non-limitative and illustrative example of an aerosol foam forming carpet freshening composition according to the invention, the compositions may be easily formed by combining all of the ingredients, except for the propellant, in a suitable valved aerosol dispenser and, after crimping the valve, adding the propellant.

EXAMPLE 1

The following ingredients are added, while mixing, to a suitable vessel, in the order given, after each previous ingredient is dispersed in the aqueous solvent. This composition is then filled into an aerosol container, the valve is crimped to the container, and the Phase B propellant A 46 is added.

| Ingredient | Amount (wt. %) |
|---|---|
| Phase A | |
| Water (deionized) | 70.800 |
| Anti-soiling carboxylated polymer salt | 0.675 |
| Isopropyl alcohol | 1.875 |
| Sodium lauryl sarcosinate | 0.300 |
| Silicone emulsion antifoaming agent | 0.375 |
| Sodium benzoate (preservative) | 0.150 |
| Triethanolamine (corrosion inhibitor) | 0.075 |
| Fragrance | 0.750 |
| Phase B | |
| Isobutane/propane (80/20) | 25.000 |

The resulting composition will dispense as a foam lasting for about 30 seconds and provide for long lasting fabric freshening superior to powdered fresheners. Although this formulation does not absorb malodors, the freshening fragrance will be more evident than in pump spray fresheners that leave little or no fragrance residual.

What is claimed is:

1. A non-cleaning foamable composition, for visibly dispensing onto a fabric, a foam containing freshening agent ingredient comprising, aqueous solvent, foaming anionic surfactant, anti-foaming agent, and freshening agent, wherein said anionic surfactant is present in a non-cleaning amount which allows for formation of a quick-breaking foam in conjunction with said anti-foaming agent.

2. The non-cleaning foamable composition according to claim 1, further comprising anti-soil redeposition agent.

3. A pressurized non-cleaning foam forming composition for dispensing a fabric freshening foam onto a fabric surface requiring freshening, comprising a valved vessel containing therein a foamable pressurized composition comprising aqueous solvent, foaming anionic surfactant in an amount ineffective to clean said fabric when applied thereto, anti-foaming agent, freshening agent, and propellant, whereby, when dispensed from said valved dispenser onto a surface, said composition forms a visible foam effective to freshen said surface.

4. The pressurized composition according to claim 3, wherein said foamable composition further comprises anti-soiling redeposition agent.

5. A method for freshening a fabric, comprising dispensing from a valved aerosol container a foam forming composition containing a freshening agent onto a first portion of said fabric, said composition containing an amount of anionic surface active agent sufficient to generate foam but insufficient to clean said fabric, from about 40 to no more than about 80 percent by weight of the composition being water or an aqueous organic solvent mixture containing no more than about 5% by weight of the mixture of organic solvent, and an anti-foaming agent in an amount effective to form a quick-breaking foam on said first portion which remains visible for no less than about 30 seconds, and allowing the foam to dissipate and air dry in no more than about 5 minutes.

6. A method for freshening a fabric as set forth in claim 5 further comprising applying additional of said foam to at least a second portion of said fabric, substantially adjacent to said first portion.

* * * * *